US005566042A

United States Patent [19]

Perkins et al.

[11] Patent Number: 5,566,042

[45] Date of Patent: Oct. 15, 1996

[54] SPRAY GUN DEVICE WITH DYNAMIC LOADLINE MANIPULATION POWER SUPPLY

[75] Inventors: Jeffrey A. Perkins, Loraine; Gerald W. Crum, Elyria; John A. Hendricks, Vickery, all of Ohio; Jeffery E. Dailidas, Barrington, Ill.

[73] Assignee: Nordson Corporation, Westlake, Ohio

[21] Appl. No.: 459,762

[22] Filed: Jun. 2, 1995

Related U.S. Application Data

[63] Continuation of Ser. No. 54,423, Apr. 8, 1993, abandoned.

[51] Int. Cl.[6] ..... B05D 1/06

[52] U.S. Cl. ..... 361/228; 361/235

[58] Field of Search ..... 361/223–235; 363/59, 60; 307/110

[56] References Cited

U.S. PATENT DOCUMENTS

| | | | |
|---|---|---|---|
| 2,767,359 | 10/1956 | Larsen et al. . | |
| 3,273,015 | 9/1966 | Fischer . | |
| 3,627,661 | 12/1971 | Gordon et al. . | |
| 3,641,971 | 2/1972 | Walberg . | |
| 3,731,145 | 5/1973 | Senay . | |
| 3,764,883 | 10/1973 | Staad et al. . | |
| 3,795,839 | 3/1974 | Walberg . | |
| 3,809,955 | 5/1974 | Parson | 361/100 |
| 3,851,618 | 12/1974 | Bentley . | |
| 3,872,370 | 3/1975 | Regnault . | |
| 3,875,892 | 4/1975 | Gregg et al. . | |
| 3,893,006 | 7/1975 | Algeri et al. . | |
| 3,895,262 | 7/1975 | Ribnitz . | |
| 3,970,920 | 7/1976 | Braun | 324/32 |
| 4,000,443 | 12/1976 | Lever . | |
| 4,038,593 | 7/1977 | Quinn | 323/4 |
| 4,073,002 | 2/1978 | Sickles et al. | 361/227 |
| 4,182,490 | 1/1980 | Kennon | 239/3 |
| 4,187,527 | 2/1980 | Bentley | 361/235 |
| 4,196,465 | 4/1980 | Buschor | 361/228 |
| 4,266,262 | 5/1981 | Haase, Jr. | 361/228 |
| 4,287,552 | 9/1981 | Wagner et al. | 361/228 |
| 4,323,947 | 4/1982 | Huber | 361/228 |
| 4,343,828 | 8/1982 | Smead et al. | 427/27 |
| 4,353,970 | 10/1982 | Dryczynski et al. | 430/31 |
| 4,377,838 | 3/1983 | Levey et al. | 361/228 |

(List continued on next page.)

FOREIGN PATENT DOCUMENTS

| | | |
|---|---|---|
| 160179 | 11/1985 | European Pat. Off. . |
| 2436142A1 | 2/1983 | Germany . |
| 3215644A1 | 10/1983 | Germany . |
| 2077006 | 12/1991 | United Kingdom . |

*Primary Examiner*—Fritz M. Fleming
*Attorney, Agent, or Firm*—Wood, Herron & Evans, P.L.L.

[57] ABSTRACT

An improved power supply for an electrostatic spray gun device having a voltage multiplier circuit adjusts to variations in the output load conditions of the multiplier circuit and dynamically modifies the operational loadline of the multiplier circuit in order to maintain optimal operating conditions for the spray gun device notwithstanding output load variations. The power supply utilizes a loadline manipulation circuit coupled to a feedback circuit that monitors the output load, and the manipulation circuit, in response to a feedback signal from the feedback circuit that is proportional to the output load, varies the input voltage level to the multiplier circuit to modify the loadline of the power supply in response to varying load conditions. The manipulator means of the power supply has memory means to store a variety of external commands which will control the manipulation means and a user interface to enter the external commands into the memory. The power supply also comprises a voltage limiting circuit coupled to the output of the multiplier circuit which regulates the output voltage level of the multiplier circuit so that when the output load current increases above a predetermined maximum level the output voltage is reduced to reduce the high voltage stress on the multiplier circuit and high voltage circuitry and reduce the amount of insulation that must surround the multiplier circuit and high voltage circuitry of the power supply in order to insulate it from ground potential.

38 Claims, 2 Drawing Sheets

U.S. PATENT DOCUMENTS

| | | | |
|---|---|---|---|
| 4,385,340 | 5/1983 | Kuroshima | 361/228 |
| 4,402,030 | 8/1983 | Moser et al. | 361/93 |
| 4,481,557 | 11/1984 | Woodruff | 361/235 |
| 4,485,427 | 11/1984 | Woodruff et al. | 361/235 |
| 4,508,276 | 4/1985 | Malcolm | 239/691 |
| 4,651,264 | 3/1987 | Hu | 363/18 |
| 4,672,500 | 6/1987 | Roger et al. | 361/93 |
| 4,674,003 | 6/1987 | Zylka | 361/235 |
| 4,710,849 | 12/1987 | Norris | 361/228 |
| 4,737,887 | 4/1988 | Thome | 361/228 |
| 4,745,520 | 5/1988 | Hughey | 361/228 |
| 4,764,393 | 8/1988 | Henger et al. | 427/8 |
| 4,809,127 | 2/1989 | Steinman et al. | 361/213 |
| 4,841,425 | 6/1989 | Maeba et al. | 363/21 |
| 4,890,190 | 12/1989 | Hemming | 361/235 |
| 4,912,588 | 3/1990 | Thomè et al. | 361/45 |
| 4,916,571 | 4/1990 | Stäheli | 361/227 |
| 5,056,720 | 10/1991 | Crum et al. | 239/698 |
| 5,063,350 | 11/1991 | Hemming et al. | 324/457 |
| 5,067,434 | 11/1991 | Thür et al. | 118/629 |
| 5,080,289 | 1/1992 | Lunzer | 239/690 |
| 5,093,625 | 3/1992 | Lunzer | 324/457 |
| 5,121,884 | 6/1992 | Noakes | 239/691 |
| 5,124,905 | 6/1992 | Kniepkamp | 363/19 |
| 5,351,903 | 10/1994 | Mazakas et al. . | |

VOLTAGE INPUT
OSC
VOLTAGE MULTIPLIER
MEMORY
MANIPULATION CIRCUIT
VOLTAGE LIMITING CIRCUIT
USER INTERFACE
EXTERNAL POWER SUPPLY
MATERIAL SUPPLY
AIR SUPPLY
IPS
kV
$V_{IN}$
$V_{OUT}$, $I_{OUT}$
$V_F$
$I_F$

4 G
2 G
1.5 G
A
1.0 G
.8 G
.6 G
B
500 M
400 M
300 M
200 M
25 VDC
23 VDC
28 VDC
30 VDC
21 VDC
OUTPUT VOLTAGE – $V_{OUT}$ (KILOVOLTS, kV)
LOAD CURRENT – $I_{OUT}$ (MICRO AMPERES, μA)

SPRAY GUN DEVICE WITH DYNAMIC LOADLINE MANIPULATION POWER SUPPLY

RELATED APPLICATIONS

This application is a continuation of application Ser. No. 08/054,423 entitled "Improved Spray Gun Device With Dynamic Loadline Manipulation Power Supply" filed Apr. 8, 1993 now abandoned which application is completely incorporated herein by reference.

FIELD OF THE INVENTION

This invention relates generally to high voltage power supplies used in electrostatic spray guns. Specifically, the invention relates to a power supply that dynamically and selectively varies its operation in response to varying load conditions.

BACKGROUND OF THE INVENTION

Electrostatic spray guns are used for various applications to spray liquid and powder coatings onto various moving or stationary objects and parts. Generally, the coating is atomized and emitted as a mist from the end of the gun having a high voltage electrode. The electrode creates an electric field and an ion flux through which the sprayed particles pass, and the ion bombardment electrostatically charges the atomized coating particles passing through the ion-rich electric field. The electrostatically charged coating particles are then directed toward the object being sprayed, which is typically electrically grounded, so that the charged particles emitted from the end of the gun are attracted to the object to provide better adherence and coverage of the object with coating material. "Spray gun" as used herein includes any electrostatic spray device, whether or not hand-held, and whether or not configured in the shape of a pistol.

Many hand-held electrostatic spray guns utilize an internal high voltage power supply to charge the electrode. These spray guns have a low level voltage input, for example from 12 to 30 volts DC, which is boosted by the internal power supply of the gun to a level that is desirable for the charging electrode, usually 50 kilovolt (KV) or more. A low voltage level input allows the input power line to the gun to be smaller and more flexible, and hence more maneuverable, because it is not necessary to insulate the line to handle high voltage levels. The internal power supply has a voltage multiplier section or circuit that increases the low level supply voltage to a voltage level that is sufficiently high to electrostatically charge the spray particles. The multiplier circuit generally operates according to a characteristic power loadline which relates a) the output or load current delivered to the electrode, i.e., the amount of current, in microamperes (μA), drawn to charge the spray particles, to b) the output voltage at the charging electrode.

The characteristic power loadline of a spray gun multiplier circuit determines the quantity and distribution of charge delivered to the spray particles, and thus controls the quality of the coating on the object being sprayed. Typically, the characteristic power loadline of the gun multiplier circuit is such that the output electrode voltage decreases as the load current delivered to the spray particles increases, and the external impedance between the charging electrode and ground reference decreases. The loadline determines the rate at which the output voltage drops with an increase in load current. The load current will tend to increase and the voltage on the electrode will consequently decrease as the grounded article being sprayed moves closer to the tip of the spray gun electrode, such as when objects moving along a production line pass closer to the gun electrode or when the gun (and electrode) is actually manipulated closer to the object to spray recesses or cavities located in it. Regardless of how the load conditions change, the load current and the output voltage generally will fluctuate during the spray application, affecting the quantity of charge on the particles and the quality of the spray coating. Therefore, while the gun may operate in the optimal range along the power loadline for a period of time during a spray application, at other times during the same spray application, it operates non-optimally because of fluctuating load conditions. For example, at a given load current the corresponding output voltage may be adequate for a particular spray application condition; however, should the gun move closer to the object being sprayed, increasing the load current, the reduced output voltage may no longer be adequate to properly charge the spray particles.

Generally, the input voltage level to the gun and multiplier circuit determines the operating power loadline of the spray gun. A problem with currently available spray guns is that they utilize power supplies with essentially fixed input levels and fixed operating loadlines. That is, they have loadlines which are desirable for certain load conditions during the spray application, but are inadequate for other load conditions during the application where the load conditions have changed. Therefore, for a particular spray application, a spray gun user is forced to choose a power supply multiplier circuit having a loadline which hopefully is suitable for a majority of load conditions likely encountered during the application, and to settle for non-optimal operation should the conditions change and cause the load to vary significantly from that selected.

One solution that has been proposed to rectify the problem of having a varying output voltage for different load current conditions, is to maintain the output voltage constant despite the changing load current levels. However, this is not a satisfactory solution for a least two reasons. First, the constant output voltage may not be the optimal operating voltage for a particular spray application once the load has changed. Secondly, when using high voltage electrodes and circuitry in an electrostatic spray gun, there is an inherent danger of electrical arcing at the gun nozzle. If arcing occurs in the presence of flammable spray material, ignition may result. The point at which arcing occurs is influenced by the energy delivered to the electrode, which, in turn, is dictated, by the output capacitance $E=\frac{1}{2}CV^2$. Power supplies are usually designed to have a loadline that is safely below the ignition point, so that when the current increases, the voltage decreases by a predetermined amount and the resulting energy level is maintained at a safe point. However, by maintaining the output voltage constant, the available discharge energy may increase to a level that is dangerous when used with a flammable spray material.

An additional drawback of currently existing spray guns having power supplies and multiplier circuits with constant loadlines is that multiple spray gun power supplies are often necessary to handle different spray applications. For example, a power supply having a particular operating loadline may be sufficient for one spray application, but not for another application, such as, where the gun nozzle has to be moved closer to the part being sprayed to coat a recess therein. Because of this, a user with a variety of spray applications is forced to purchase multiple gun power supplies. With guns having self-contained, or internal power supplies, this can be a severe financial burden.

While varying load conditions present the problems of low coating quality and adherence, and quite possibly the hazards of arcing and ignition of the spray material, additional problems can also arise. For example, a very low load current and the resulting high electrode output voltage stress the electrical components of the spray gun power supply, and specifically, the components of the voltage multiplier stage and its associated circuitry. The voltage multiplier circuit and the associated circuitry which supplies high voltage to the charging electrode are typically surrounded with an insulating dielectric material of predetermined thickness designed to isolate the high voltage circuitry from ground potential. The insulative material, if it is not thick enough, may electrically break down and begin to conduct electricity when subject to the very high voltages that exist in the multiplier circuit. This insulation, therefore, must have a particular minimum thickness to withstand the high voltage levels in the power supply and prevent electrical breakdown of the insulation, this minimum thickness of insulation being referred to as the "isolation distance". The isolation distance is determined by the maximum voltage level that may exist in the multiplier circuit.

The maximum multiplier output voltage and the associated electrode voltage is achieved when the load current is at 0 (μA) microamperes or what is considered the "no load" condition. For a particular multiplier the "no load" condition may correspond to an output voltage above 120 KV, and quite possibly above 150 KV. Therefore, the insulation surrounding the high voltage sections of the power supply must have a minimum thickness dimension or isolation distance that can withstand the maximum voltage at the "no load" point, and so, the isolation distance is determined by the "no load" voltage level. A typically reliable isolation distance requires approximately one rail (or one thousandth of an inch) of insulating material per every 400 volts that the insulation must withstand. For a "no load" output voltage level of a 150 KV, this would correspond to an isolation distance of approximately 0.375 inches. Such a large amount of insulation material around the multiplier circuit and other high voltage circuitry in the power supply makes the spray gun heavy and bulky. However, reliable performance of the power supply dictates that a minimum isolation distance must be maintained or the insulation may break down during the spray operation and render the power supply inoperable.

It is an object of the present invention to provide an improved power supply for an electrostatic spray gun which provides optimal, or near optimal, particle charging regardless of load variations encountered during operation, such as variations in the distance between the high voltage electrode and the object being coated, and which further provides for a reduction in the insulation required for the high voltage circuit components to insure safe operation under "no load" conditions.

It is further an objective of the present invention to provide a spray gun power supply which eliminates the necessity of purchasing several guns and/or high voltage supplies to handle different spray applications.

It is a still further objective of the present invention to provide a spray gun power supply that reduces the "no load" voltage so as to reduce the required isolation distance of the insulation, thereby providing a lighter, less bulky and more reliable spray gun.

SUMMARY OF THE INVENTION

The present invention accomplishes these objectives by providing an improved power supply for an electrostatic spray gun which adjusts to fluctuating load current conditions and dynamically modifies the operational loadline of the multiplier circuit of the power supply in order to maintain optimal operating conditions for the spray gun notwithstanding load current variations. The power supply of the invention accomplishes this by utilizing a loadline manipulation circuit that is coupled to receive a feedback signal that is indicative of load conditions at the multiplier circuit output. The feedback signal is generated by a feedback sensor network that is coupled to the secondary coil of an input transformer, which, in turn, is coupled to the input of the multiplier circuit of the power supply so that the feedback sensor network is coupled to the multiplier circuit. The feedback signal generated at the input of the voltage multiplier is indicative of the current load conditions at the multiplier output. In response to the feedback signal containing the load condition information, the manipulation circuit adjusts the input voltage level to the multiplier section of the power supply so that the multiplier circuit operates along modified loadlines under differing load current conditions.

In one embodiment, the manipulation circuit receives external commands from a user via an interface which indicate the load condition or boost points at which the power supply is to operate along a modified loadline and the particular input voltage percentage or level boost value that will achieve the desired modified loadline. The load condition points correspond to particular load conditions that are reflected by the feedback signal, such as output voltage levels or load current levels at the gun nozzle, at which it is desirable to shift the power supply to operate along the different operational loadlines. In another embodiment, the manipulation circuit contains a memory section which stores a pre-programmed set or sets of load condition or boost points and the associated input voltage boost values corresponding to the boost points for changing the multiplier input voltage levels. For example, each set of boost points may correspond to a particular spray application or a particular spray material. The user, through the interface, then chooses the particular spray application or spray material, and the manipulation circuit automatically chooses the appropriate set of load condition boost points and the corresponding input voltage boost values that are necessary to dynamically modify the loadline so that the spray gun operates optimally for that chosen spray application. In either of these embodiments, when the load conditions, via the feedback signal, indicate that the loadline has reached a particular load condition boost point, the manipulation circuit varies the voltage input level to the multiplier circuit to modify the loadline. Therefore, the power supply of the present invention adjusts automatically to continually optimize the high voltage output and improve the spray quality and gun performance notwithstanding varying application conditions which create a varying load current.

In another aspect of the current invention, the improved spray gun power supply comprises a voltage limiting circuit which regulates the output voltage on the charging electrode when the load current decreases below a predetermined level. As stated earlier, for a typical multiplier circuit, the loadline dictates how the output voltage increases as the load current decreases. As a consequence, for low current levels or a "no load" condition, the multiplier may produce a voltage level approximately twice that which is required for normal operation of the spray gun. At these high voltage levels, the electrical components of the multiplier circuit and associated high voltage circuitry are stressed and the insulation surrounding the multiplier circuitry must have a larger than necessary thickness to prevent electrical breakdown and shorting of the power supply. The voltage limiting circuit of the present invention maintains the output voltage at or below a predetermined maximum level, when the load voltage seeks to exceed the predetermined maximum level such as in the "no load" output condition. The voltage limiting circuit monitors the voltage across a voltage divider network coupled to the output of the multiplier circuit, and the voltage is proportional to the output voltage of the multiplier. When this output voltage rises above a predetermined level, the voltage limiting circuit provides an input to the manipulator circuit to vary the input voltage level to the multiplier circuit such that the output voltage is maintained below the pre-determined maximum level. In this way, the isolation distance, or minimum thickness of the insulation around the high voltage circuitry, may be reduced, thus reducing the bulkiness and weight of the spray gun. Moreover, the reduced amount of high voltage stress on the insulation and the high voltage circuitry improves the overall reliability of the power supply. Additionally, since the power supply does not achieve its normal "no load" peak voltage, the spray gun is ultimately safer because the lower maximum voltage can bleed down to a safe level faster so as to prevent arcing and possible ignition of the spray material. The predetermined limit point for the output voltage level is set above the maximum voltage necessary for normal operation of the spray gun for a given application, and therefore, despite the voltage limiting effect of this aspect of the invention, the power supply is capable of producing electrostatic charges similar to those produced by power supplies having higher "no load" voltages.

These and other objectives of the present invention will become more evident from the detailed description of the preferred embodiment given below taken in conjunction with the drawings.

DETAILED DESCRIPTION OF THE PRESENT INVENTION

Figures 1, 2, 5:
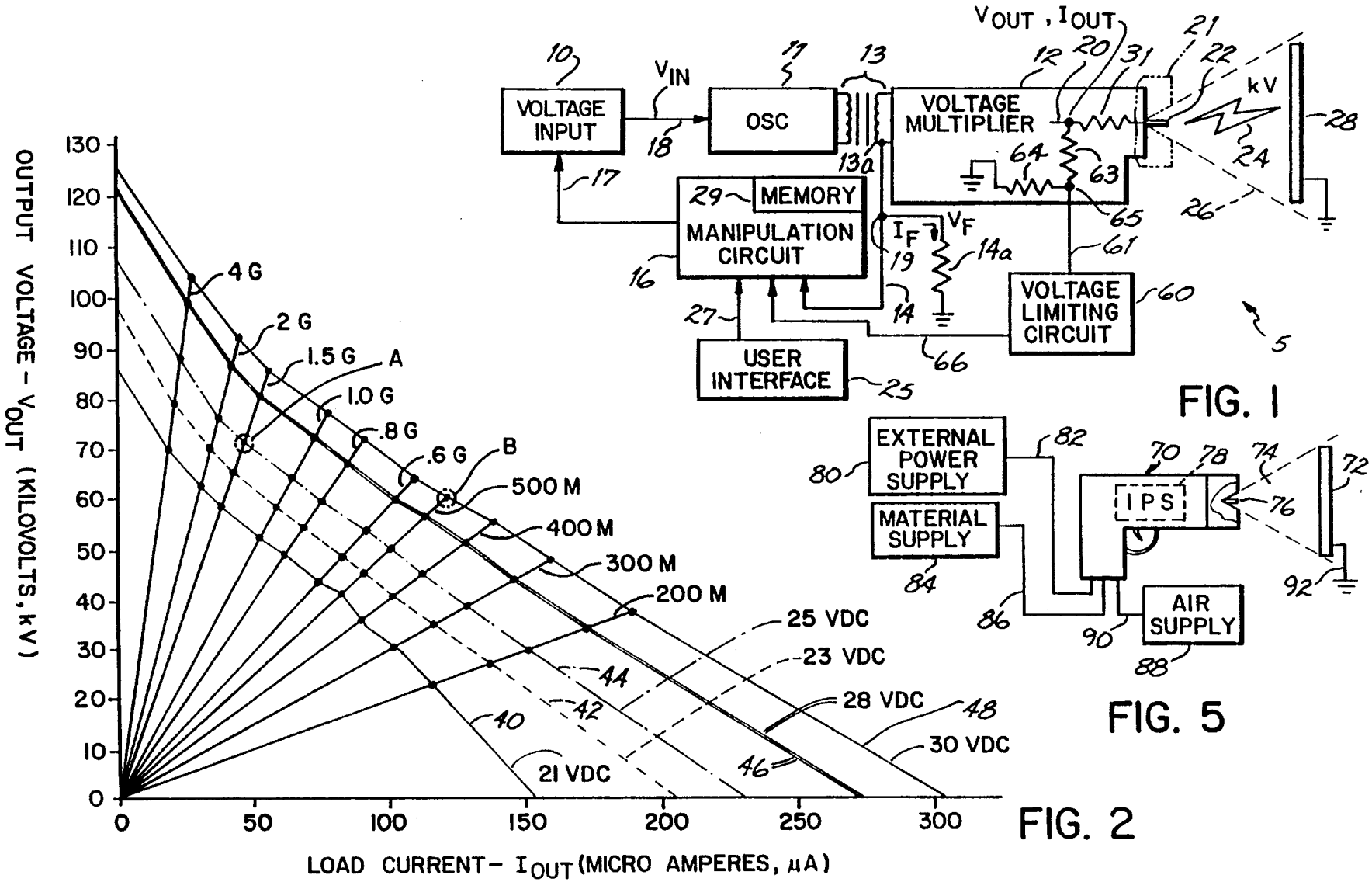
FIG. 1 is a block circuit diagram of the dynamic loadline manipulation power supply of the present invention.
FIG. 2 is a graph of operational loadlines for an electrostatic spray gun multiplier circuit for varying multiplier input voltages.
FIG. 5 is an electrostatic spray coating system utilizing the dynamic loadline manipulation power supply of the present invention.

The circuit diagram of FIG. 1 shows the dynamic loadline manipulation power supply 5, of the present invention. A voltage input circuit 10 supplies an input voltage $V_{IN}$ to an input oscillator 11 which is coupled to a voltage multiplier circuit 12 through a transformer 13. The voltage multiplier 12 produces an output voltage $V_{OUT}$ and output load current $I_{OUT}$. A feedback line 14 is coupled to the "common" side of the secondary coil 13*a* of transformer 13, which is connected to ground potential through a resistor 14*a*. The current $I_F$ is proportional to the load current $I_{OUT}$ at the output of the voltage multiplier 12. Therefore, the voltage of feedback signal $V_F$ across resistor 14*a* is proportional to load current $I_{OUT}$. Line 14 conveys the feedback signal $V_F$, proportional to the output current, to manipulation circuit 16. The manipulation circuit 16 varies the level of input voltage $V_{IN}$ via line 17 in response to $V_F$, and thus, modifies the operational loadline of the multiplier circuit 12 according to the fluctuating output load conditions.

A typical input voltage $V_{IN}$ from input circuit 10 may range from 12 to 30 volts DC, and is input to the oscillator 11 and step transformer 13 which act as an input stage to the multiplier circuit 12 and raises the input voltages to a level acceptable to the multiplier circuit input. The voltage multiplier multiplies the input voltage to a high voltage output $V_{OUT}$ generally in the 60–100 kilovolt (KV) range. The output voltage $V_{OUT}$ of multiplier circuit 12 is supplied on line 20 to a charging electrode 22. The voltage multiplier circuit 12 may take one of several forms, but a preferred embodiment of the present invention utilizes a Cockcroft-Walton type multiplier circuit having a series of capacitor and diode stages (not shown) to produce a high output voltage $V_{OUT}$ for a particular spray application. The high voltage charging electrode 22 is located proximate the tip 21 of the electrostatic spray gun where it creates an electric field and corona 24. As atomized particles of the spray material 26, which may be liquid or powder, pass through the field 24, they acquire an electrostatic charge thereon. The charged particles 26 are sprayed or otherwise conveyed towards the electrically grounded object 28, and when the charge particles pass in proximity to the object 28, they are attracted thereto. The charging of the spray particles 26 promotes uniform material coating on the grounded object 28. Atomization of the particles can be achieved in any of the well known manners, which forms no part of this invention and therefore is not further described.

The voltage multiplier circuit 12 of power supply 5, operates according to what is generally referred to as a power loadline which defines the relationship between the output or load current level $I_{OUT}$ and the output voltage level $V_{OUT}$ of the multiplier circuit 12. Typically, there is a decreasing relationship between the output voltage $V_{OUT}$ and the load current $I_{OUT}$. That is, as the load current $I_{OUT}$ increases, the output voltage $V_{OUT}$ decreases (See FIG. 2). The operational loadline of the multiplier circuit 12, therefore, determines the rate at which the output voltage $V_{OUT}$ drops in response to increasing load current flow. During operation of power supply 5, an increase in load current $I_{OUT}$ will normally occur when the tip 21 of the spray gun and the charging electrode 22 are moved in close proximity to the grounded object 28 that is being sprayed, such as when it is necessary to spray a recess or indentation within the object 28.

The input voltage $V_{IN}$ to the input oscillator 11 and step-up transformer 13 and multiplier circuit 12 determines the loadline at which the multiplier circuit 12 operates. Currently available spray gun power supplies have a constant input voltage $V_{IN}$ which is chosen to yield an operating loadline that is optimal for the particular spray application for which the electrostatic spray gun is being used. The loadline, and hence the relationship between the output voltage $V_{OUT}$ and load current $I_{OUT}$ are chosen, for currently available power supplies, by using such parameters as the type of material being sprayed, such as whether it is powder or liquid, the shape of the object 28 being sprayed, and the necessary proximity of the gun nozzle 21 and charging electrode 22 to the object 28. Using these parameters, the input voltage $V_{IN}$ of commercially available spray guns is preset so that multiplier circuit 12 yields a constant loadline that hopefully achieves the desired quality of coating for the particular spray application.

It may be appreciated that a constant loadline may be desirable at certain spray application conditions but undesirable during other conditions, such as when the load conditions fluctuate. Moreover, for various different spray applications, it is often necessary to purchase different electrostatic spray guns and/or power supplies, because the characteristic loadline and operation of the power supply in one gun is set for a particular spray application and is not appropriate for a distinctly different spray application. The present invention solves these problems of existing electrostatic spray guns by manipulating the operational loadline of the multiplier circuit 12 of high voltage spray gun power supply 5 in response to the changing output conditions encountered in a single application. In this way, operation of power supply 5 is optimized for a particular spray application. Furthermore, the invention allows a single gun containing power supply 5 to be used for a large variety of different spray applications, because the loadline of the present invention is automatically optimized for different applications encountered in use. Thus, the present invention eliminates the need to purchase a plurality of guns and/or power supplies to handle a wide variety of spray applications.

Referring now to FIG. 2, a number of typical multiplier operational loadlines are shown for various input voltages to a multiplier circuit 12. As discussed above, the operational loadline of the power supply 5, and more specifically the loadline of the multiplier circuit 12, determines the relationship between the output voltage $V_{OUT}$ at electrode 22 and the load current $I_{OUT}$ that is delivered to electrostatically charge the particles 26 of the spray stream. As mentioned above, the loadline of a typical multiplier circuit 12 is determined by the input voltage level $V_{IN}$ to the multiplier circuit 12. In FIG. 2, several typical multiplier loadlines are shown, and the lower loadline 40 corresponds to an input voltage of 21 volts DC while the upper loadline 48 corresponds to an input voltage of 30 volts DC. The loadlines between these upper and lower limits, i.e., loadlines 42, 44 and 46, correspond to input voltages of 23, 25 and 28 volts DC, respectively. As may be appreciated, the loadlines 40, 42, 44, 46 and 48 illustrated in FIG. 2 are not exhaustive, and there will generally be a unique loadline associated with each value of the input voltage $V_{IN}$. The loadlines of FIG. 2 illustrate that as the input voltage $V_{IN}$ to multiplier circuit 12 increases, the operational loadlines move generally upward on the graph.

The present invention modifies the loadline of the multiplier circuit 12 in response to varying load conditions at the gun nozzle 21, and hence, modifies the loadline of the spray gun power supply 5 since the multiplier circuit 12 loadline typically dictates the operation of the power supply 5. The loadline is modified by the present invention in order to optimize the output voltage $V_{OUT}$ at the charging electrode for a particular load condition and load current $I_{OUT}$ draw. In a preferred embodiment, the modification of the loadline is accomplished by varying the input voltage $V_{IN}$ which is supplied by the voltage input circuit 10. The voltage input circuit 10 for a spray gun having an internal voltage power supply and multiplier circuit 12 may typically comprise simply a power line connected to an external DC power source to supply the low DC voltage $V_{IN}$ on line 18. However, in addition to the voltage input circuit 10, a spray gun power supply usually includes an oscillator 11 and a step-up transformer 13 to boost the voltage level $V_{IN}$ from the voltage input circuit 10 to an input level that is at an appropriate level for input to the multiplier circuit 12.

Referring again to FIG. 2, various straight lines emanating from the origin intersect the loadlines to show the operating points of the multiplier circuit 12 for various load conditions. The loadlines 40, 42, 44, 46 and 48 each intersect the vertical axis at their specific "no load" point ($I_{OUT}$=O μA) where the output voltage $V_{OUT}$ at the electrode 22 attains its maximum level for that particular loadline. Conversely, where each of the loadlines 40, 42, 44, 46, and 48 intersects the horizontal axis corresponds to a short circuit condition ($V_{OUT}$=OKV) where the operating load current $I_{OUT}$ attains its maximum level. Each set of marked points (as indicated by straight lines) along the loadlines between the "no load" and "short circuit" points correspond to various load conditions ranging from a 4 Gigohm load down to a 200 Megohm load. It may be seen in FIG. 2, that, as the load impedance conditions decrease, the load current $I_{OUT}$ increases, and consequently, the output voltage $V_{OUT}$ at the charging electrode 22 decreases.

The operation of the present invention is best illustrated by an example. Referring to FIG. 2, for a particular spray application and spray powder, if the load current $I_{OUT}$ is 50 microamps (μA), the optimal electrode charging voltage $V_{OUT}$ for operation of the gun may be, based upon empirical factors, approximately 70 kilovolts (KV) as indicated by point A. To achieve that optimal operating point A, it is desirable to have the power supply 5 of the spray gun operate along loadline 44 which corresponds to an input voltage $V_{IN}$ to the multiplier circuit 12 of 25 volts DC. However, if the load current increases to a 125 microamps during the spray application, such as when the grounded part 28 moves closer to gun nozzle 21 and electrode 22 and the load resistance drops, the empirically determined desirable output voltage may be approximately 62 KV as designated by point B in FIG. 2. Point B, corresponds to loadline 48 which requires an input voltage $V_{IN}$ of 30 volts DC. In accordance with the operation of the present invention, $V_{IN}$ is gradually increased from 25 volts DC to 30 volts DC by manipulation circuit 16 to modify the operation of multiplier circuit 12 so that it smoothly shifts from point A to point B when feedback signal $V_F$ indicates that the load current has increased from 50 μA to 125 μA. In the absence of the loadline modification provided by the present invention, an increase of current $I_{OUT}$ to 125 μA on loadline 44 would result in the output voltage $V_{OUT}$ dropping from 70 KV to approximately 40 KV which may be unacceptable to sufficiently charge the spray particles 26 for the particular spray application.

The power supply 5 of the present invention is versatile in that it adapts to changes in the load conditions which may occur in a single spray application having varying load conditions. Moreover, it may be used to configure the same spray gun for several different applications which have distinctly different load conditions. In the past, since the power supplies of commercially available spray guns have operated essentially along a single, fixed loadline, different spray applications might require several different spray guns and/or power supplies. Modifying the operational loadline of the spray gun for varying load conditions eliminates the multiplicity of guns and/or power supplies that are necessary in the past for various applications, because a gun containing power supply 5 of the present invention can handle a wide spectrum of spray applications that normally might require several different guns and/or power supplies with fixed power loadlines.

Referring again to FIG. 1, the voltage input 10 initially provides a $V_{IN}$ on line 18 to voltage multiplier circuit 12, and the multiplier circuit 12 outputs a current $I_{OUT}$ and high output voltage $V_{OUT}$, and the spray gun begins operation along a loadline that corresponds to the chosen magnitude of $V_{In}$. The output voltage $V_{OUT}$ is supplied to the charging electrode 21 through safety resistor 31 on line 20 to charge electrode 21 and create an electric field and an associated corona 24. The particles 26 of spray material are directed through the electric field and its corona 24 or ion flux, and the spray particles 26 acquire an electrostatic charge through an ion bombardment with the ionized particles of the corona. The stream of particles then moves towards grounded object 28 where they are attracted by the opposite electrical polarity and deposit on object 28 to form the desired associated coating. Power supply 5 will continue to operate along the initial loadline as long as the output load conditions, as indicated by $V_{OUT}$ and $I_{OUT}$, are desirable for the chosen spray application and spray material. For a range of varying spray conditions of a chosen spray application, there typically is a range of output voltage and load current combinations which have been empirically determined to be desirable for those varying spray conditions. When the load conditions deviate outside of this desirable output range, such as when the load current $I_{OUT}$ draw increases, the loadline is modified by the present invention so that the spray gun again operates in a desirable output range.

The loadline modification of the present invention is initiated by a feedback line 14 which provides a feedback signal $V_F$ to manipulation circuit 16 which is coupled to the voltage input circuit 10 by line 17. The feedback signal $V_F$ on line 14 is proportional to the amount of load current $I_{OUT}$ that is being drawn through charging electrode 22 in order to electrostatically charge spray particles 26. The manipulation circuit 16, based on the level of feedback signal $V_F$, varies the input voltage $V_{IN}$ to smoothly modify the loadline of multiplier circuit 12 so that the gun operates at an optimal electrode voltage $V_{OUT}$ for the particular spray application and the load current $I_{OUT}$. Manipulation circuit 16 is coupled, through line 17, to voltage input circuit 10, which may be a variable voltage power supply. Manipulation circuit 16 commands input circuit 10 to produce an input voltage $V_{IN}$ level on line 18 which produces the desired loadline in response to the changing load conditions. In this way, the present invention continually monitors the spray gun output to ensure optimal operation for varying load conditions.

The feedback $V_F$ on line 14 may be accomplished in various ways as long as it conveys the necessary load condition information needed by the manipulation circuit 16 to shift loadlines. For example, in the embodiment of the present invention shown in FIG. 1, a resistor 14A is connected to ground from the common line **13*a* of the secondary coil of step-up transformer 13. The current $I_F$ traveling through resistor 14*a* is proportional to the output load current $I_{OUT}$. Consequently, the feedback voltage signal $V_F$ is also proportional to the current $I_{OUT}$. Therefore, any increase of $I_{OUT}$ on line 20 is reflected as a change in the feedback signal voltage $V_F$ across resistor 14. Feedback line 14 is connected to resistor 14*a* at point 19, and thus, the feedback signal input to manipulation circuit 16 is proportional to the load current $I_{OUT}$. Other feedback schemes may be utilized without departing from the scope of the present invention with the feedback signal proportional to the changing load conditions, such as changing load current $I_{OUT}$ or load voltage $V_{OUT}$. The feedback voltage $V_F$ on line 14 is input to manipulation circuit 16 which, as stated above, adjusts the output level of voltage input circuit 10 to supply a $V_{IN}$ level that will modify the operational loadline of the voltage multiplier circuit 12. By dynamically modifying the operational loadline of the multiplier circuit 12**, the spray gun maintains the desired performance and the spray particles have a proper adhesion charge.

In normal operation of an electrostatic spray gun assembly, certain physical conditions exist which vary the load conditions. For example, as gun-to-object distance decreases, load current $I_{OUT}$ increases. To insure optimal charging of the particles under varying load current conditions, it has been empirically determined that the output voltage $V_{OUT}$ should have a particular value for a particular output load current $I_{OUT}$ value. It has been discovered that the desired change in output voltage $V_{OUT}$ for a given change in output load current $I_{OUT}$ cannot be achieved if the voltage multiplier operates along a single, fixed loadline. Therefore, the present invention dynamically modifies the loadline in response to varying output conditions.

To this end, manipulation circuit 16 may have various embodiments to achieve the desired loadline modifying. Generally, the output voltage and load current combinations, and their corresponding loadlines, for the various spray applications and load conditions are empirically or otherwise predetermined so that the input voltage $V_{IN}$ may be chosen to produce the desired operation of the spray gun for particular load conditions.

In one embodiment of the present invention, the manipulation circuit 16 is a microprocessor having internal or external memory 29. The microprocessor 16 is responsive to all inputs indicating the load conditions, i.e., the feedback signal $V_F$, and also to inputs from an external device which indicate the desirable load condition boost points at which loadline modification will occur. In response to these inputs, the manipulation circuit 16 then outputs a signal on line 17 to control voltage input circuit 10 to vary the input level $V_{IN}$. Referring again to FIG. 1, microprocessor 16 is connected to a user interface 25 by line 27. The user interface could be a keyboard (not shown) or some other input device. A user begins by inputting various load condition boost points for a particular spray application, inputting associated input voltage level boost values for each load condition boost point. The boost value indicates to the microprocessor 16 the maximum amount of voltage level increase that it must affect on the input voltage $V_{IN}$ to achieve a desired loadline for the particular load boost point. The number of boost points and the frequency of loadline modification that is necessary for a particular application will depend upon the actual spray application and the various load conditions that are encountered during that application.

Figure 3:
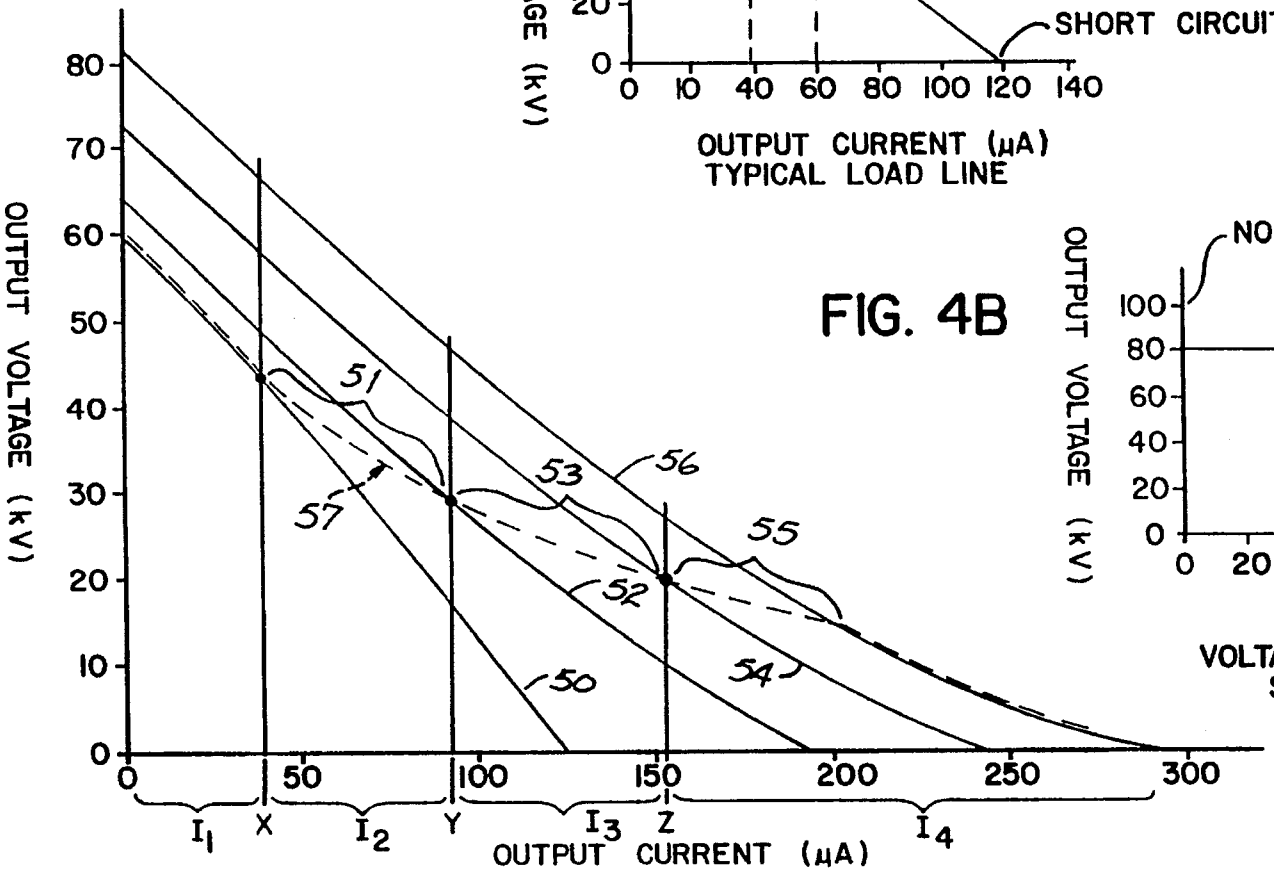
FIG. 3 is a graph of an operational loadline produced using the present invention.

Referring to FIG. 3, an example using several different load condition boost points is presented. FIG. 3 shows four typical loadlines 50, 52, 54, and 56, for a multiplier circuit. The sequence begins with the user entering a series of load condition boost points along with the input voltage boost values associated with the boost points via interface 25. For example, boost points X, Y, and Z and their associated input voltage boost values are entered. In this embodiment of the present invention, the load condition boost points would have units in μA because the feedback signal $V_F$ which indicates when the boost point has been reached by the output levels, is proportional to the load current $I_{OUT}$. In another embodiment however, other units may be used so as to be compatible with the type of feedback scheme adopted for use in the present invention.

The load condition boost points X, Y and Z are entered through user interface 25 into microprocessor 16 and are stored in memory 29 for subsequent use. Also entered and stored along with the load condition boost points, are the maximum amounts or boost values that the input voltage $V_{IN}$ must be increased or decreased for each of these points to modify the loadline to achieve the desired operation of the spray gun. That is, associated with each boost point is a particular input voltage boost value which controls how the input voltage is varied to modify the loadline. The input voltage boost value may be expressed as a percentage change, such as a 50% increase of the input voltage $V_{IN}$ associated with a boost point. Similarly, the boost value may be a negative value to affect an input voltage decrease for a boost point if that is desirable to achieve optimum gun operation.

To further illustrate the relationship between boost points and boost values, the user may input a boost value of 50% for a chosen boost point. When the feedback signal indicates that the load current $I_{OUT}$ has reached that boost point, the input voltage will begin to gradually increase and will continue to increase until the output current level reaches the next boost point or until a maximum value for $V_{IN}$ has been reached. When the output current $I_{OUT}$ reaches the next boost point or when $V_{IN}$ has reached a maximum level, the input voltage level $V_{IN}$ will be at a 50% higher level than it was prior to the boost point increase. Therefore, the boost value is the maximum level increase of $V_{IN}$ that will occur for a particular boost point. The rate of increase that $V_{IN}$ attains as it gradually increases between two boost points is determined by the boost value. For example, when a first boost point has been reached, the input voltage $V_{IN}$ will increase gradually as the output current $I_{OUT}$ moves to the next boost point. At the next boost point, the $V_{IN}$ value will have increased to its maximum level or its boost value for the first boost point. This maximum level is determined by the percentage boost. Therefore, if the boost value was 50%, the $V_{IN}$ level at the second boost point will be 50% higher than it was at the first boost point. This increase (or possibly a decrease if the boost value is negative) continues from boost point to boost point and, depending upon the associated boost values, the modified loadlines, 51, 53, and 55 will have different slopes. When each successive boost point is reached, the $V_{IN}$ value will continue to increase according to the boost value associated with that boost point, or it may decrease if the boost value is a percentage decrease. If the boost value is 0%, then the input voltage level $V_{IN}$ will remain constant and will then continue operation along the typical characteristic loadline associated with that input voltage level as the load current increases. In this way, the microprocessor 16 uses the boost points and boost values to control voltage input circuit 10 and direct it vary the level of $V_{IN}$ and modify the operation of the multiplier circuit 12.

Referring to FIG. 3 for a more specific illustration, the operation of the gun power supply 5 may start off along loadline 50 and when the load current $I_{OUT}$ reaches the boost point signified by point X, the processor 16 gradually increases the input voltage $V_{IN}$ according to the predetermined and pre-entered boost value associated with boost point X. In this way, as the output current $I_{out}$ increases past boost point X, the input voltage $V_{IN}$ gradually increases and the spray gun operates along modified loadline 51 which extends between multiplier loadlines 50 and 52. As stated above, the increase in $I_{out}$ is indicated by a varying feedback signal $V_F$. If the load current $I_{OUT}$ continues to increase to the point corresponding to boost point Y, then the $V_{IN}$ value will reach the maximum boost percentage that is associated with boost point X. At boost point Y, there is a boost percentage associated with that boost point. If that boost percentage for point Y is 0%, then the multiplier circuit 12 will operate along line 52 because that is the typical characteristic loadline corresponding to that input voltage $V_{IN}$ level. However, if there is a particular positive boost value assigned with boost point Y, the multiplier circuit 12 operates along loadline 53 due to an additional gradual increase of $V_{IN}$ as $I_{OUT}$ increases past boost point Y. The increase will continue until $I_{out}$ reaches boost point Z where the $V_{IN}$ value will have reached the maximum level corresponding to the boost percentage associated with point Y. If the load current continues to further increase during the spray application, such as when the grounded object 28 moves closer to gun nozzle 21, then the $I_{OUT}$ level may reach and exceed boost point Z. Again, if the boost value associated with boost point Z is 0%, then the multiplier circuit will operate along characteristic loadline 54 for $I_{OUT}$ levels beyond point Z. However, a boost value for point Z may yield operation of the multiplier along line 55. As may be seen in FIG. 3, when the $I_{OUT}$ value increases beyond point Z, the multiplier operates along modified loadline 55 and then operates along the typical loadline 56. This is because the boost value associated with point Z will raise the value of $V_{IN}$ to a maximum level which cannot be exceeded by input circuit 10. At this predetermined maximum level, the increase of $V_{IN}$ will stop, regardless of whether that $V_{IN}$ value achieves the boost value associated with point Z, and the multiplier 12 will operate along loadline 56. In this way, for a particular spray application, the spray gun power supply 5 may operate along dashed line 57. The resulting operational loadline 57 of the multiplier circuit 12 has a smaller slope than the standard operational loadlines 50, 52, 54, and 56 of a typical power supply multiplier circuit. When the operational loadline is somewhat flattened, i.e., when the voltage at the gun tip is changes only a small amount in spite of increasing output current flow, the power supply is said to have a stiff loadline. Such a stiff loadline, as it is achieved by the present invention, is a desirable characteristic during operation of the spray gun.

The load current values between each load condition point X, Y and Z may also be thought of as load current zones, $I_1$, $I_2$, $I_3$, and $I_4$ (See FIG. 3). Whenever the load current $I_{OUT}$ has a value that falls within a particular current zone, the multiplier circuit 12 operates along the modified loadline associated with that zone. For example, if the $I_{OUT}$ value is in zone $I_1$, the multiplier circuit 16 operates along typical loadline 50. However, if the $I_{OUT}$ value increases past boost point X and into current zone $I_2$, the microprocessor 16 operates along the modified loadline 51. Similarly, if the load current is in $I_3$ or $I_4$, modified loadlines 53 and 55, respectively, will result. It is not always the case that the loadline will continually shift, and, in fact, it is normally desirable that it not shift at all. That is, if possible, it would be desirable to keep the operation of the power supply 5 within a single current zone, say $I_2$ and on a single modified loadline, say 51 or on a typical, unmodified loadline 52. However, this is not always the case, and therefore, the present invention adapts to varying load current conditions to yield a modified loadline.

By shifting the loadline in this way, the present invention achieves optimal operation of the spray gun for a spray application having varying output load conditions. Alternatively, through user interface 25 a preset $V_{IN}$ can be chosen which will produce a single loadline that is desirable for the entire spray operation if it has been determined that, for that application, the output load conditions do not fluctuate very significantly. Therefore, the present invention can be used for various spray applications whether it is desirable to have a dynamically shifting loadline or whether it is simply sufficient to choose a single loadline that is used throughout the spray application. Consequently, the present invention eliminates the need to purchase various different guns and/or power supplies to accommodate various spray applications.

Where the example discussed above utilized one set of boost points for a single spray application, an alternative embodiment of the present invention, using memory section 29 of microprocessor 16, stores a plurality of predetermined sets of boost points and their associated sets of boost values, which will produce the desired modified loadlines when the output load conditions reach the various stored boost points. Each set of boost points may correspond to a unique spray application or even to a particular object shape to be sprayed. In this way, the user enters the desired spray application through interface 25 and the microprocessor circuit 16 automatically chooses, for the spray application, the appropriate set of boost points and the associated boost values for these points to modify the loadline depending upon the load current $I_{OUT}$ level.

Similarly, the memory 29 may contain various sets of current zones in which the microprocessor circuit 12 is to operate. For example, referring again to FIG. 3, the microprocessor circuit 16 may have, stored in memory, various sets of current zones, such as set $I_1$, $I_2$, $I_3$, and $I_4$, which control the modification of the multiplier circuit loadline through the associated sets of boost values with the sets of current zones. Whenever the load current $I_{OUT}$ passes from one current zone, to an adjacent current zone, the new boost value will control the microprocessor circuit 16 to vary the input voltage $V_{IN}$ through input circuit 10 so as to produce a new loadline. Therefore, instead of boost points, current zones may be entered by a user through interface 25 or will be stored in microprocessor memory 29 to control the loadline shifting of the multiplier circuit 12. Other types of microprocessor operating schemes may be devised without deviating from the scope of the present invention. Similarly, other control circuitry might be utilized, other than microprocessor circuit 16, to control the loadline modification of the present invention.

When the resistance or impedance of the load at the gun nozzle 21 decreases closer to the "short circuit" condition, such as when the object 28 to be sprayed moves closer to the gun nozzle 21, it can be seen from FIG. 2 that the output $I_{OUT}$ increases somewhat rapidly. In such a high current or reduced load impedance condition, there is a possibility that an electrical arc may occur from the electrode 22 to the grounded object 28 as the object 28 is moved close to the gun nozzle 21, or the gun nozzle moves closer to the object 28. Not only is there a danger of shock to anyone close to the gun nozzle 21, but if the powder or material 26 being sprayed is combustible, then ignition and a subsequent flash of flame may occur. While the dynamic shifting of the loadline achieved by the present invention may be used to keep the power supply 5 operating at a safe output current range, such as by designating a negative boost value if the $I_{OUT}$ level exceeds a particular limit boost point, other precautions may be taken to prevent arcing. To this end, as shown in FIG. 1, the present invention utilizes a safety resistor 31 to keep the loadline below a certain critical operating range.

In another aspect of the present invention, the output of multiplier circuit 12 is coupled to a voltage limiting circuit 60 by line 61 to maintain the output voltage $V_{OUT}$ below a predetermined level when the load current $I_{OUT}$ decreases close to the "no load" or $I_{OUT}$=0 μA point. It may be seen from FIG. 2 that when the load current $I_{OUT}$ decreases to 0 μA, the output voltage $V_{OUT}$ begins to climb rapidly. Typically, multiplier circuit 12, conduction path 20 and any other high voltage circuitry which supplies power to charging electrode 22 are covered by an insulative dielectric material (not shown). The dielectric insulation electrically isolates the high voltage areas of the power supply from the grounded chassis of the spray gun or other nearby sources of ground potential that, if contacted, may render the power supply inoperable.

Figure 4A:
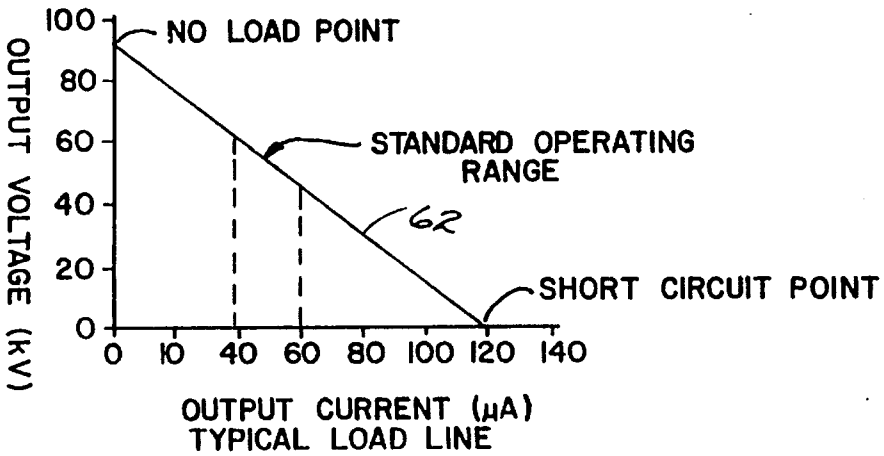
FIG. 4A is a graph of an operational loadline for a conventional electrostatic spray gun power supply.

Referring to FIG. 4A, an electrostatic spray gun power supply 5 generally has a loadline 62 which extends from a "no load" or open circuit point to the maximum load or "short circuit" point, and at the "no load" point, the maximum amount of output voltage $V_{OUT}$ is delivered. However, the typical operating range of output voltage $V_{OUT}$ and load current $I_{OUT}$ that is necessary for the spray gun to properly deliver its charged spray coating is somewhere in the middle of the loadline, where the output voltage is significantly lower than the maximum output voltage at the "no load" point. If the insulation surrounding the multiplier circuit 12 and other high voltage sections of power supply 5 is not thick enough when the load current $I_{OUT}$ drops to low levels and the output voltage begins to climb towards its maximum "no load" level, then the insulation material may experience electrical break-down. That is, its insulative and current resistive properties may be reduced and it may begin to conduct electrical current. Should this occur, the output of the power supply 5 may contact or arc to a nearby ground potential and the power supply, specifically multiplier circuit 12, may be rendered inoperative.

The minimum thickness of insulation that is necessary to handle these high voltage levels and not electrically breakdown and conduct current is referred to as the "isolation distance". Since the insulation material must be able to handle the maximum output voltage in the power supply, the "isolation distance" is designed around the "no load" point, where the multiplier circuit 12 has its highest $V_{OUT}$ level. Therefore, since the normal operating range of the multiplier circuit 12 is sometimes substantially below the "no load" point, there is generally considerably more insulation material around the high voltage circuitry 12, 20 than is necessary for the normal operating range of the gun power supply 5. Consequently, available spray guns with internal power supplies have always been overly heavy and bulky due the excess insulation material that is needed to withstand the high output voltage at the "no load" point.

Figure 4B:
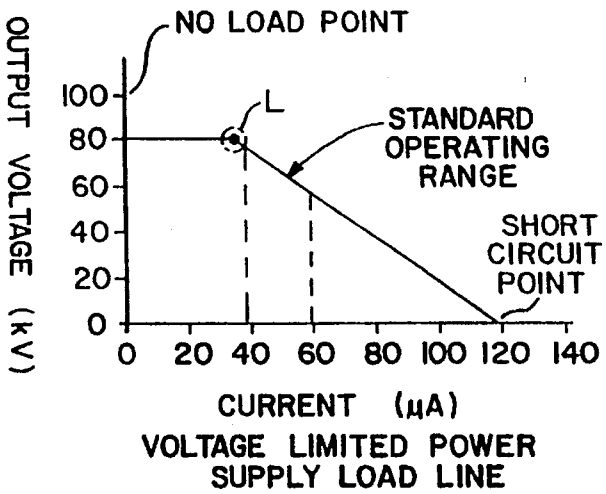
FIG. 4B is the voltage limited operational loadline for the power supply of the present invention.

The present invention utilizes voltage limiting circuit 60 to monitor the output voltage $V_{OUT}$ when load current $I_{OUT}$ levels decrease toward a "no load" or 0 μA point. The voltage limiting circuit 60 is connected to the output of the multiplier circuit 12 through a voltage divider comprising resistors 63 and 64. It has been determined that the voltage signal available at point 65 of the voltage divider is indicative of the output voltage $V_{OUT}$ of the multiplier circuit 12. When the load voltage level $V_{OUT}$ increases above a predetermined maximum value, as indicated by point 65 in the voltage divider network, voltage limiting circuit 60 sends a signal to microprocessor 16 on line 66. The manipulation circuit varies the input voltage level $V_{IN}$ to keep the output voltage $V_{OUT}$ at a level substantially below its normal "no load" voltage which occurs when the output current level $I_{OUT}$ is low. Referring to FIG. 4B, when the load current level $I_{OUT}$ drops to the point indicated by point L and the output voltage $V_{OUT}$ reaches 80 KV, for example, the voltage limiting circuit 60 begins to limit the output voltage $V_{OUT}$ by varying the input voltage $V_{IN}$ through manipulation circuit 16 to maintain the voltage output of the multiplier circuit 12 substantially below its typical "no load" high voltage point. Preferably, this limiting point L is at a load current level that is below the lower current limit of the standard operating range of the gun. In this way, while the gun is operating in its standard output range the normal operating loadline of multiplier circuit 12 is maintained and the necessary amount of power is delivered to the charged particles 26. Using the voltage limiting circuit of the present invention, the isolation distance that is necessary to insulate the high voltage circuitry is reduced because the output voltage $V_{OUT}$ is limited to stay well below the "no load" point of the power supply and the maximum $V_{OUT}$ is now at a level signified by point L, which may be 80 KV, for example, and not 100 KV.

A typically reliable isolation distance requires approximately one-thousandth of an inch (1 mil) of solid insulation material per 400 volts that must be withstood. From FIG. 4B, the voltage limiting circuit 60 of the present invention limits the output voltage $V_{OUT}$ from exceeding approximately 80 KV. Normally, at the "no load" point in FIG. 4A, the output voltage $V_{OUT}$ might be approximately 100 KV. Assuming an isolation distance requirement of 400 volts per mil of solid material, voltage limiting circuit 60 allows the power supply 5 to operate reliably and safely with approximately 0.050 inches less isolation distance, and hence, less insulation material around the high voltage circuits. The reduced amount of insulation material, in turn, results in a lighter, smaller and more reliable power supply 5 than may normally be achieved if the power supply is allowed to deliver the characteristic high output voltages for low level current loads. Additionally, when the power supply 5 is voltage limited by limiting circuit 60 to a voltage $V_{OUT}$ that is substantially lower than the "no load" voltage, the electrode 22, is less likely to arc because the voltage on electrode 22 can be reduced down to a safe level much more quickly, given that the maximum voltage does not exceed the level at point L during the operation of power supply 5.

As may be appreciated, the power supply of the present invention may be used in a typical electrostatic spray coating system as shown in FIG. 5. An electrostatic spray devices such as electrostatic spray gun 70 is utilized to spray a part 72 with coating material 74. The electrode 76 of spray gun 70 may be powered by an internal power supply 78 (shown in phantom) like the power supply 5 of the present invention. Alternatively, gun 70 may be powered from an external power supply 80 which is connected to gun 70 by a high voltage cable 82. Preferably the external power supply 80 utilizes the improved power supply 5 of the present invention. Also included in the coating system of FIG. 5 is a material supply 84 which is connected to the gun such as through hose 86 to supply spray material which is applied to object 72. Spray material may be either powder or liquid or any other appropriate material for spraying through gun 70. Additionally, the coating system may utilize an air supply 88 in appropriate hoses 90 if the system utilizes air to apply material 74 to object 72. In order to enhance adherence of the spray material 74 to the chosen object, the coating system often utilizes a means 92 to ground the object 72.

While the present invention has been illustrated by the description of a preferred embodiment and while the preferred embodiment has been described in some detail, it is not the intention of the applicants to restrict or in anyway limit the scope of the appended claims to such detail. Additional advantages and modifications will readily be apparent to those skilled in the art. For example, a manipulation circuit 16 might take various forms to provide different ways of manipulating the loadline. Furthermore, manipulation circuit 16 can be modified to accept a variety of different inputs through user interface 25, such as to select a shifting scheme for a particular spray application or for various different parts to be sprayed. Additionally, other ways of using feedback to control the operation of a control circuit may be devised without varying from the scope of this invention. The invention in its broader aspects is therefore not limited to the specific details, representative apparatus and method, and illustrated example shown and described. Accordingly, departures may be made from such details without departing from the spirit or scope of the applicants' general inventive concept.

We claim:

1. A power supply for use in an electrostatic spray device comprising:

a voltage input circuit for supplying an input voltage;

a voltage multiplication circuit coupled to said voltage input circuit for producing a power supply output in response to said input voltage, the power supply output providing operating power for the electrostatic spray device and including an output voltage and an output load current, said output voltage magnitude varying inversely with the output load current magnitude generally within an operating range of the voltage multiplication circuit and as a function of the magnitude of the output load current; and a manipulation circuit coupled to said voltage multiplication circuit for dynamically manipulating the power supply output from the voltage multiplication circuit generally within its standard operating range to vary the functional relationship between the output voltage and the output load current and to maintain both the output voltage and output load current in preselected operating ranges during operation of the power supply;

whereby the output of the power supply is automatically manipulated during operation of the electrostatic spray device.

2. The power supply of claim 1 wherein the manipulation circuit is dynamically responsive to changing load conditions at the power supply output to vary the functional relationships at the power supply output during operation of the spray device.

3. The power supply of claim 2 further comprising a feedback line connected between the voltage multiplication circuit and the manipulation circuit and coupled directly to the voltage multiplication circuit to provide a feedback signal proportional to the changing load conditions at the output of the power supply, the manipulation circuit responsive to the feedback signal to dynamically manipulate the power supply output and vary the functional relationship at the power supply output.

4. The power supply of claim 1 further comprising a user interface coupled to the manipulation circuit for inputting at least one external command into the manipulation circuit, the manipulation circuit responsive to the external command to vary the output functional relationship and maintain the output voltage and output load current in the preselected operating ranges.

5. The power supply of claim 4 wherein the manipulation circuit includes memory to store at least one external command from a user, the manipulation circuit responsive to the stored external command.

6. The power supply of claim 1 further comprising a voltage limiting circuit coupled between the multiplication circuit and the manipulation circuit to monitor the level of the output voltage and provide a limit signal, the manipulation circuit responsive to the limit signal to maintain the output voltage and output load current in the preselected operating ranges.

7. A power supply for use in an electrostatic spray device dynamically responsive to varying electrical load conditions to maintain an output voltage and an output load current of a power supply output in preselected operating ranges, comprising:

a voltage input circuit for supplying an input voltage;

a voltage multiplication circuit coupled to said voltage input circuit for producing the power supply output with an output voltage having a magnitude which varies inversely with the output load current magnitude generally within an operating range of the voltage multiplication circuit and as a function of the magnitude of the output load current, said voltage multiplication circuit having a selectively variable operational loadline which determines the functional relationship between the magnitude of said output voltage and the magnitude of said output load current within said operating range; and apparatus for dynamically selecting the operational loadline of the voltage multiplication circuit within its standard operating range by monitoring one of the output voltage and output load current of said voltage multiplication circuit;

whereby the output of the power supply is dynamically manipulated by selecting the operational loadline of the multiplication circuit during operation of the electrostatic spray device.

8. The power supply of claim 7, the selecting apparatus including:

a feedback device coupled directly to said voltage multiplication circuit to monitor one of said output voltage and output load current and provide a feedback signal proportional to one of said output voltage and output load current; and a manipulation circuit responsive to said feedback device and electrically coupled to said voltage multiplication circuit to select the operational loadline of said voltage multiplication circuit and vary the functional relationship at the power supply output in response to said feedback signal.

9. The power supply of claim 8 wherein said manipulation circuit is coupled to said multiplication circuit through said voltage input circuit to vary the input voltage magnitude and thereby select the operational loadline of said voltage multiplication circuit in response to variations in load conditions.

10. The power supply of claim 9, wherein said manipulation circuit comprises a processor having an input responsive to said feedback apparatus and an output connected to said voltage input circuit to control variation of the input voltage level to said voltage multiplication circuit;

a user interface coupled to said processor to receive at least one external command from a user and input said command to said processor, said processor responsive to said external command and said feedback signal to modify said processor output to control variation of the input voltage level to said voltage multiplication circuit and, in turn, select the operational loadline of said voltage multiplication circuit.

11. The power supply of claim 10 wherein the processor varies the input voltage magnitude by a preselected amount when the power supply output from said voltage multiplication circuit has reached a predetermined load condition boost point;

said external command to the processor including the designation of at least one load condition boost point and at least one associated input voltage boost parameter to determine the preselected variation in the input voltage magnitude from said voltage input circuit that occurs at said load condition boost point;

the feedback signal input to said processor means indicating when the power supply output reaches said load condition boost point.

12. The power supply of claim 11, wherein said processor includes memory which stores at least one set of pre-programmed load condition boost points and a set of input voltage boost parameters associated with the load condition boost points set for controlling said processor to select the loadline of the voltage multiplication circuit;

whereby the processor operates automatically according to said pre-programmed set of load condition boost points and boost parameters to select the loadline.

13. The power supply of claim 12 wherein said memory stores a plurality of sets of pro-programmed load condition boost points and a plurality of sets of associated input voltage boost parameters for selecting the voltage multiplication circuit loadline;

the processor responsive to external commands from said user interface to select at least one set of load condition boost points and an associated set of boost parameters from said plurality of sets to thereby select said loadline according to said chosen set;

whereby the processor stores said sets of load condition boost points and said sets of associated boost parameters for each of a variety of different spray applications, and the user chooses a particular spray application by making the processor select the set of boost points and boost parameters corresponding to a particular spray application through use of the interface.

14. The power supply of claim 8, wherein said feedback device includes a resistor connected between the multiplication circuit and ground potential, a current proportional to the output load current flowing through said resistor;

said feedback signal proportional to the varying voltage across said resistor that results from increases and decreases in the output load current;

whereby said feedback signal is responsive to varying load current levels.

15. The power supply of claim 8 further comprising a voltage limiting circuit coupled to the output of said voltage multiplication circuit, the limiting circuit monitoring the level of the output voltage, and modifying the output voltage level of said multiplication circuit when the output voltage reaches a predetermined maximum voltage level, said voltage limiting circuit maintaining the output voltage below said predetermined maximum voltage level.

16. The power supply of claim 15, said voltage limiting circuit being coupled to said manipulation circuit, the manipulation circuit responsive to said voltage limiting circuit to select the operational loadline.

17. The power supply of claim 16 wherein voltage limiting circuit is coupled to a voltage divider network which is connected to the output of said multiplication circuit, said voltage divider network yielding a voltage signal that is proportional to the output voltage of the voltage multiplication circuit and the voltage limiting circuit being responsive to said voltage signal.

18. A coating system for applying a coating material to an object comprising:

an electrostatic spray device with an electrode for spraying coating material onto an object;

a system for supplying coating material to the spray device so that it may be sprayed therefrom;

a power supply connected to the electrode to charge the electrode so that it electrostatically charges the coating material as it is sprayed from the spray device, the power supply comprising:

a voltage input circuit for supplying an input voltage;

a voltage multiplication circuit coupled to said voltage input circuit for producing a power supply output in response to said input voltage, the power supply output including an output voltage and an output load current, said output voltage magnitude varying inversely with the output load current magnitude generally within an operating range of the voltage multiplication circuit and as a function of the magnitude of the output load current; and a manipulation circuit coupled to said voltage multiplication circuit for dynamically manipulating the power supply output of the voltage multiplication circuit within its standard operating range to vary the functional relationship between the output voltage and output load current and to maintain both the output voltage and output load current in preselected operating ranges during operation of the power supply;

whereby the output of the power supply is automatically manipulated during operation of the electrostatic spray device.

19. The coating system of claim 18 wherein the output voltage has a magnitude which varies as a function of the magnitude of the output load current, the voltage multiplication circuit having a selectively variable operational loadline which determines the functional relationship between the magnitude of the output voltage and the magnitude of the output load current generally within said operating range, and the manipulation circuit dynamically manipulating the power supply output of the voltage multiplication circuit and selecting the operational loadline of the voltage multiplication circuit within said operating range by monitoring one of the output voltage and the output load current.

20. The coating system of claim 19 further comprising:

a feedback device coupled directly to said voltage multiplication circuit to monitor one of said output voltage and output load current and provide a feedback signal proportional to one of said output voltage and output load current; and said manipulation circuit being responsive to said feedback device and electrically coupled to said voltage multiplication circuit to select the operational loadline of said voltage multiplication circuit in response to said feedback signal.

21. The coating system of claim 18 wherein the power supply is located externally of the electrostatic spray device, the coating system further comprising:

a high voltage cable connecting the external power supply to the electrostatic spray device to charge the electrode of the spray device.

22. The coating system of claim 18 further comprising a pressurized air supply connected to the electrostatic spray device to facilitate spraying coating material onto an object using air.

23. The coating system of claim 18 wherein the coating material supplied to the electrostatic spray device is one of a powder material and a liquid material.

24. The coating system of claim 18 wherein the electrostatic spray device is an electrostatic spray gun.

25. The coating system of claim 18 further comprising a grounding device to ground the object being sprayed.

26. A method of dynamically responding to varying load conditions at the output of an electrostatic spray device during operation of the spray device to achieve improved spray coating of an object comprising:

a.) providing an input voltage;

b.) multiplying said input voltage with a multiplier circuit to produce a spray device output including an output voltage and an output load current said multiplying step producing an output wherein said output voltage magnitude varies inversely with the output load current magnitude generally within an operating range of the voltage multiplication circuit and as a function of the magnitude of the output load current;

c.) dynamically manipulating the output of the multiplier circuit with a manipulation circuit generally within a standard operating range of the multiplier circuit to vary the functional relationship between the output voltage and the output load current and to maintain both the output voltage and output load current in preselected operating ranges during operation of the electrostatic spray device;

whereby the spray device output is manipulated during operation of the electrostatic spray device for improved spray coating.

27. The method of claim 26 wherein the output voltage and output load current of the multiplier circuit are related along a selectively variable operational loadline so that the magnitude of said output voltage generally within said operating range varies as a function of the magnitude of said output load current, the method further comprising:

a) dynamically manipulating the multiplier circuit output by selecting the loadline of the multiplier circuit in response to one of the output voltage and the output load current to vary the functional relationship at the output.

28. The method of claim 27 further comprising:

a) selecting the loadline using the manipulation circuit which is operably connected to the multiplier circuit to control the operation of the multiplier circuit.

29. The method of claim 28 further comprising:

a) selecting the loadline by coupling a feedback signal directly from the multiplier circuit to the manipulation circuit, the feedback signal being proportional to the spray device output and the manipulation circuit selecting the loadline in response to the feedback signal.

30. The method of claim 29 further comprising:

a.) monitoring the voltage across a resistor that is connected between the multiplier circuit and ground potential to provide the feedback signal, a current proportional to the output load current of the multiplier circuit flowing through the resistor to provide the feedback signal which is proportional to variations in said load current; and b) selecting the loadline in response to variations in the feedback signal.

31. The method of claim 27 further comprising:

a.) selecting the loadline of the multiplier circuit by varying the magnitude of said input voltage with the manipulation circuit.

32. The method of claim 27 further comprising selecting the loadline by:

a.) entering at least one external command into a user interface coupled to the manipulation circuit;

b.) using the external command to select the loadline in response to the spray device output.

33. The method of claim 32 further comprising selecting the loadline by:

a.) entering at least one load condition boost point through said user interface;

b.) entering at least one input voltage level boost parameter through said user interface;

c.) selecting the loadline by varying the input voltage magnitude with the manipulation circuit according to the input voltage level boost parameter when the output of the spray device has reached a load condition boost point.

34. The method of claim 33 wherein entering the load condition boost point and input voltage level boost parameter further comprises:

a.) storing, in memory within said manipulation circuit, at least one set of pre-programmed load condition boost points and at least one set of associated, pre-programmed input voltage boost parameters; and b) selecting the loadline automatically according to said pre-programmed set of load condition boost points and said set of boost parameters to dynamically manipulate operation of the spray device.

35. The method of claim 34 wherein said memory stores a plurality of sets of pre-programmed load condition boost points and a plurality of sets of associated input voltage boost parameters; the step of selecting the loadline further comprising:

a.) choosing at least one set of load condition boost points and one set of associated boost parameters from said plurality of sets through said user interface;

whereby the memory stores a set of load condition boost points and a set of associated boost parameters for each of a variety of different spray applications and the user chooses the set of boost points and boost parameters to yield a loadline for a particular spray application.

36. The method of claim 26 further comprising:

a.) monitoring the spray device output with a voltage limiting circuit to determine when said output voltage increases above a predetermined maximum voltage level;

b) generating a limit signal with the voltage limiting circuit when the output voltage reaches said maximum level; and c) modifying the output voltage of said multiplier circuit in response to said limit signal to maintain the output voltage below said predetermined maximum voltage.

37. The method of claim 36 further comprising:

a.) coupling the voltage limiting circuit to the manipulation circuit; and b.) varying the input voltage level with the manipulation circuit to modify the output voltage level of said multiplier circuit in response to said voltage limiting circuit limit signal.

38. The method of claim 36 wherein the voltage limiting circuit is coupled to a voltage divider network which is connected to the output of the multiplier circuit, the voltage divider network yielding a voltage signal that is proportional to the output voltage of the multiplier circuit, and the voltage limiting circuit using said voltage signal to generate the limit signal.

* * * * *

UNITED STATES PATENT AND TRADEMARK OFFICE

CERTIFICATE OF CORRECTION

PATENT NO. : 5,566,042

DATED : October 15, 1996

INVENTOR(S) : Jeffrey Perkins et al.

It is certified that error appears in the above-identified patent and that said Letters Patent is hereby corrected as shown below:

In the Abstract, line 2, insert --which— before "adjusts."

In Column 3, line 32, delete "rail" and insert --mil--.

In Column 11, line 48, delete "direct it" and insert --directly--.

In Column 12, line 32, delete "is".

In Column 15, line 38, delete "devices" and insert --device--.

In Column 18, line 18, delete "pro-programmed" and insert --pre-programmed--.

Signed and Sealed this

Twenty-first Day of April, 1998

Bruce Lehman

*Attest:*

BRUCE LEHMAN

*Attesting Officer*

*Commissioner of Patents and Trademarks*